US012146703B2

(12) United States Patent
Gallucci et al.

(10) Patent No.: US 12,146,703 B2
(45) Date of Patent: Nov. 19, 2024

(54) REFRIGERATOR APPLIANCE

(71) Applicant: WHIRLPOOL CORPORATION, Benton Harbor, MI (US)

(72) Inventors: Jordano Gallucci, Joinville (BR); Amol Shailendra Gode, Pune (IN); Isadora Camargo Góss, Joinville (BR); Dheeraj Nandkishor Malewadkar, Pune (IN); Vishal Jaywantrao Patil, Pune (IN); Gustavo Spezzia, Joinville (BR); Jeevan Madhukar Yadav, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 355 days.

(21) Appl. No.: 17/579,745

(22) Filed: Jan. 20, 2022

(65) Prior Publication Data

US 2023/0228479 A1 Jul. 20, 2023

(51) Int. Cl.

| | |
|---|---|
| ***F25D 25/02*** | (2006.01) |
| ***A47B 45/00*** | (2006.01) |
| ***A47B 96/02*** | (2006.01) |
| *F25D 23/06* | (2006.01) |

(52) U.S. Cl.

CPC ..... *F25D 25/02* (2013.01); *A47B 45/00* (2013.01); *A47B 96/025* (2013.01); *F25D 25/024* (2013.01); *F25D 23/067* (2013.01); *F25D 25/021* (2013.01); *F25D 2325/021* (2013.01)

(58) Field of Classification Search

CPC .... F25D 23/067; F25D 25/021; F25D 25/024; F25D 2325/021; F25D 2325/022; F25D 25/02; A47B 96/025; A47B 96/027; A47B 96/021; A47B 45/00

See application file for complete search history.

(56) References Cited

U.S. PATENT DOCUMENTS

| | | | | |
|---|---|---|---|---|
| 1,925,371 A * | 9/1933 | Charter | F25D 25/02 126/339 |
| 1,997,432 A * | 4/1935 | Replogle | F25D 25/02 126/339 |
| 2,010,927 A * | 8/1935 | Paulus | F25D 25/02 312/351 |
| 3,264,049 A | 8/1966 | Peterson | |

(Continued)

FOREIGN PATENT DOCUMENTS

| | | | | |
|---|---|---|---|---|
| CN | 208595748 U | 3/2019 | | |
| DE | 2051841 A1 * | 4/1972 | | |
| GB | 2396096 A * | 6/2004 | | A47B 96/025 |

*Primary Examiner* — Kimberley S Wright

(74) *Attorney, Agent, or Firm* — Brooks Kushman P.C.

(57) ABSTRACT

A refrigerator includes a cabinet and a shelf. The cabinet has a rear wall and opposing side walls extending forward from the rear wall. The rear wall and opposing side walls define an internal cavity. The shelf is disposed within the internal cavity, has a base portion defining a plurality of aligned grooves, and has an extendable portion having a plurality of aligned protrusions. Each protrusion is disposed and slidable within one of the aligned grooves. The extendable portion is configured to transition between first and second positions relative to the base portion via sliding the plurality of aligned protrusions within the plurality of aligned grooves.

17 Claims, 6 Drawing Sheets

(56) References Cited

U.S. PATENT DOCUMENTS

| | | | | |
|---|---|---|---|---|
| 3,334,954 | A * | 8/1967 | Kesling | A47B 88/483 312/351 |
| 3,450,072 | A * | 6/1969 | Farkas | A47B 45/00 108/143 |
| 6,142,321 | A * | 11/2000 | West | A47B 45/00 211/175 |
| 9,033,438 | B2 | 5/2015 | Kelley et al. | |
| 9,801,496 | B1 * | 10/2017 | Lu | A47J 37/0694 |
| 10,881,198 | B1 * | 1/2021 | Chaoyi | A47B 45/00 |
| 2007/0228909 | A1 * | 10/2007 | Hwang | F25D 31/007 312/408 |
| 2012/0223038 | A1 * | 9/2012 | Bean | A47B 96/021 29/527.1 |
| 2014/0175037 | A1 * | 6/2014 | Dart | A47B 57/583 211/186 |
| 2015/0068999 | A1 * | 3/2015 | Dart | A47B 57/20 211/186 |
| 2016/0270535 | A1 * | 9/2016 | Dart | A47B 71/00 |
| 2016/0273828 | A1 * | 9/2016 | Burke | F25D 25/021 |
| 2019/0017741 | A1 | 1/2019 | Staud et al. | |
| 2021/0235862 | A1 * | 8/2021 | Dart | A47B 96/021 |

* cited by examiner

REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a cabinet and a shelf. The cabinet has a rear wall and opposing side walls extending forward from the rear wall. The rear wall and opposing side walls define an internal cavity. The shelf is disposed within the internal cavity, has a base portion defining a plurality of aligned grooves, and has an extendable portion having a plurality of aligned protrusions. Each protrusion is disposed and slidable within one of the aligned grooves. The extendable portion is configured to transition between first and second positions relative to the base portion via sliding the plurality of aligned protrusions within the plurality of aligned grooves.

A refrigerator includes a cabinet and a shelf. The cabinet defines an internal cavity. The shelf is disposed within the internal cavity, has a base defining slots, and has an expansion member having protrusions extending therefrom. Each protrusion is disposed and slidable within one of the slots. A width of the shelf is adjustable via sliding the protrusions within the slots.

A refrigerator shelf includes a primary portion and a secondary portion. The primary portion defines keyed grooves. The secondary portion includes elongated protrusions that are extendable from and retractable within the grooves in order to adjust a width of the shelf.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
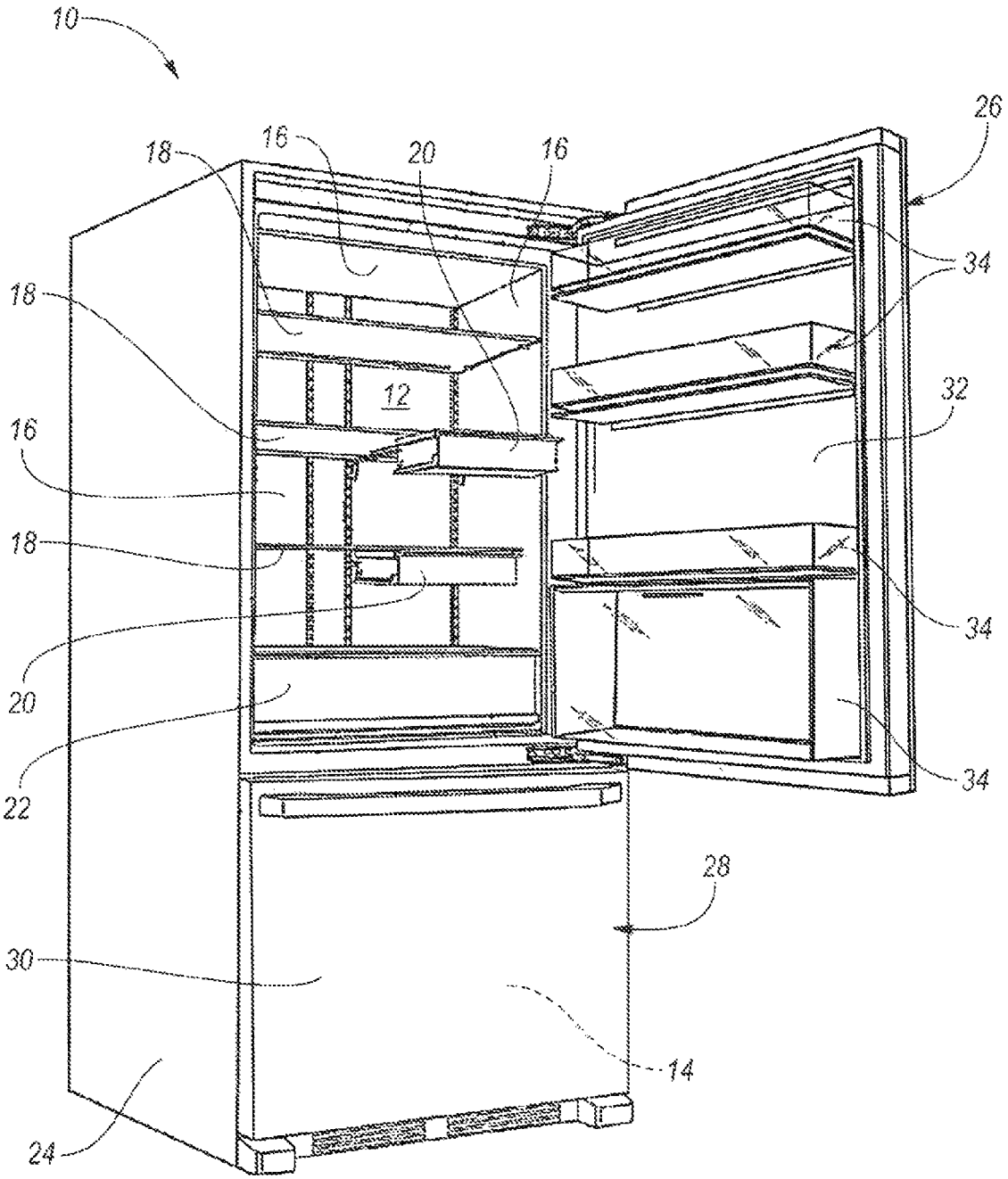
FIG. 1 is an isometric front view of a bottom-mount type refrigerator appliance with the refrigeration compartment door open.
Figure 2:
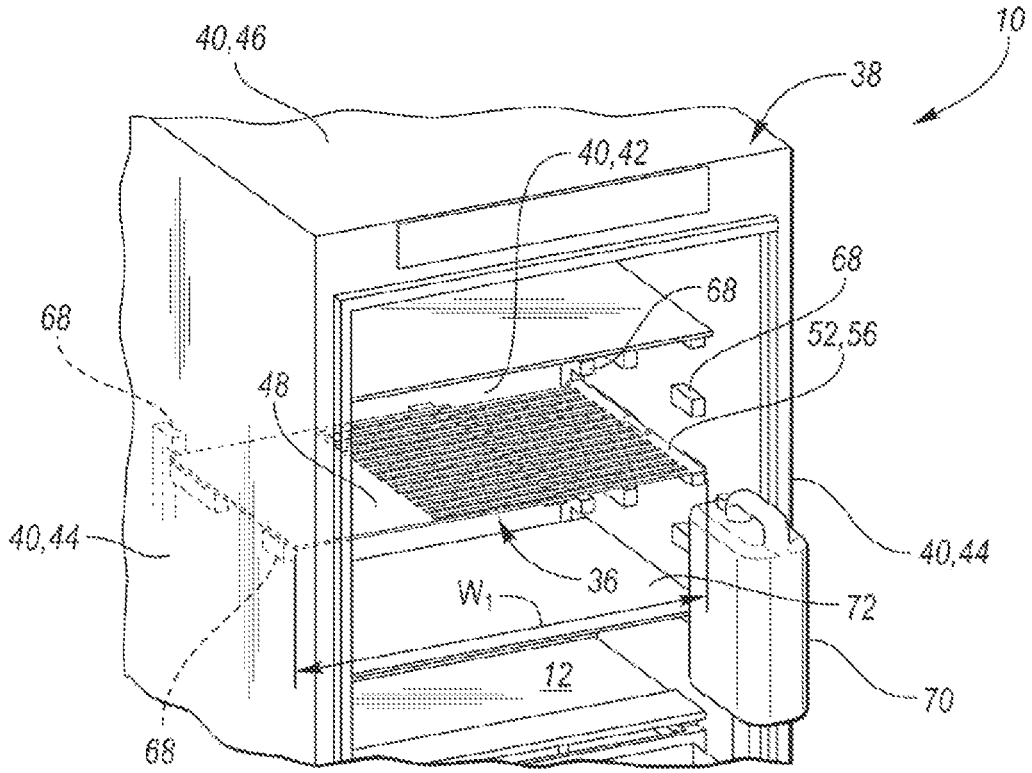
FIG. 2 is a partial isometric front view of the refrigerator with the door removed illustrating an adjustable shelf in a first position.
Figure 3:
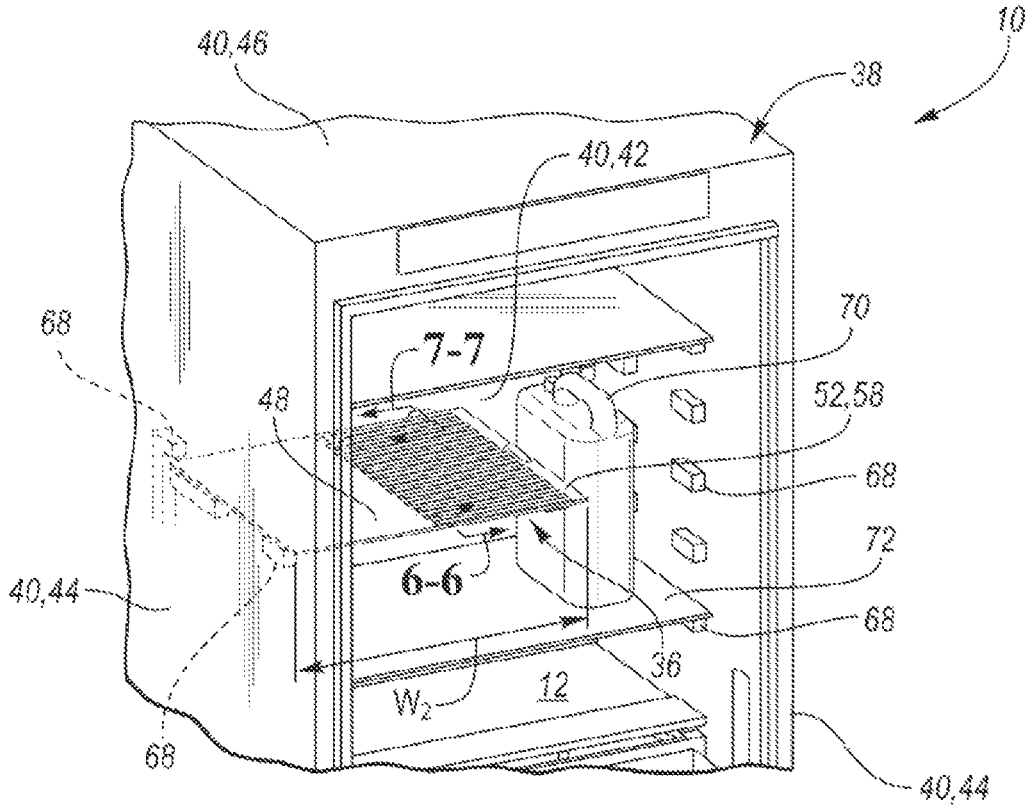
FIG. 3 is a partial isometric front view of the refrigerator with the door removed illustrating the adjustable shelf in a second position.
Figure 4:
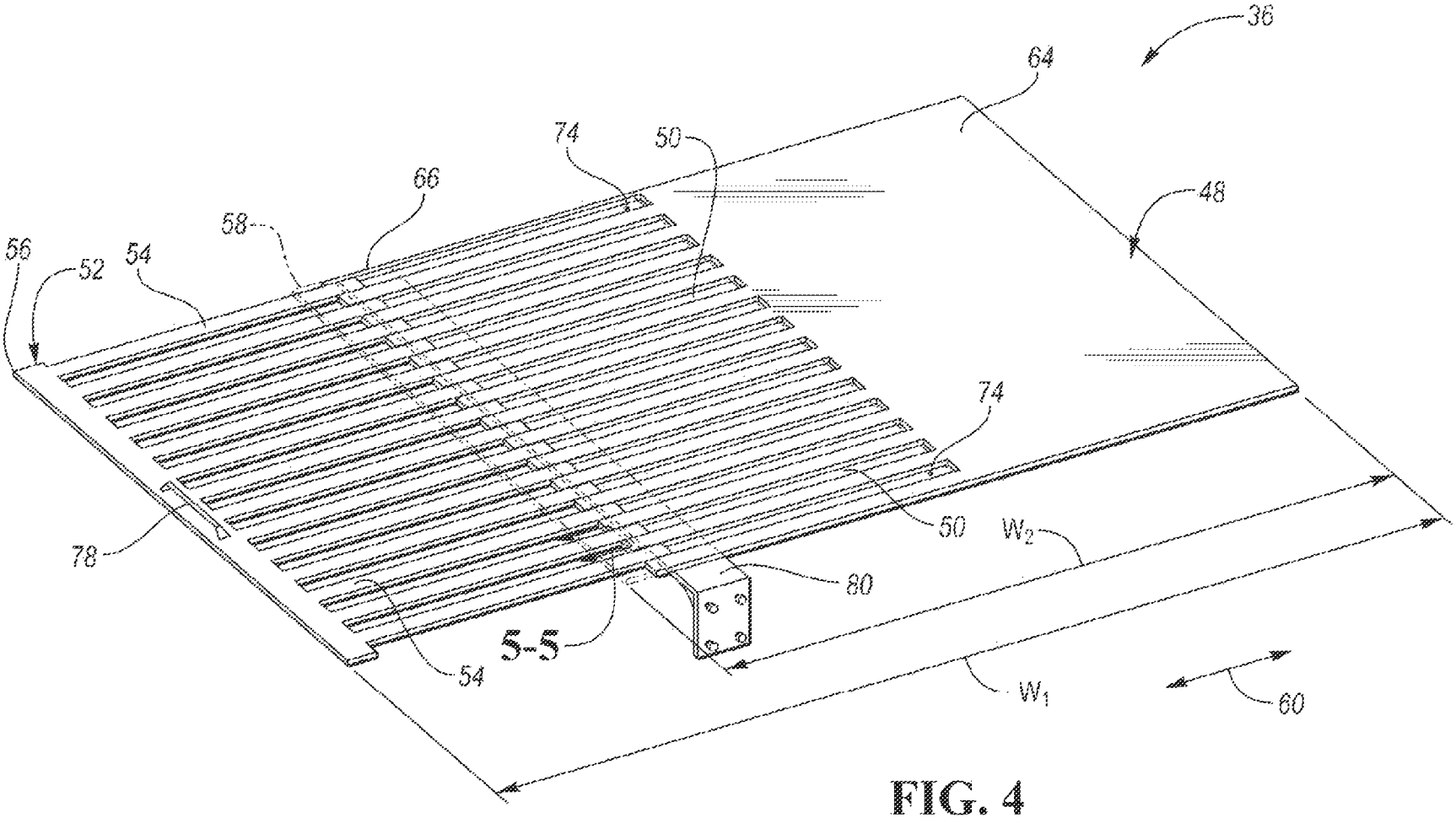
FIG. 4 is an isometric rear view of the adjustable shelf.
Figure 5:
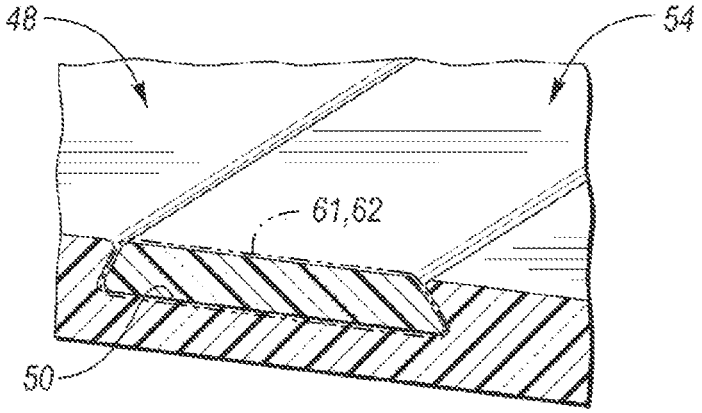
FIG. 5 is a cross-sectional view taken along line 5-5 in FIG. 4.
Figure 6:
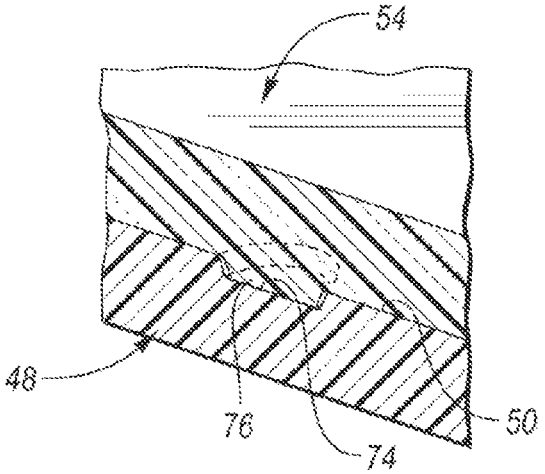
FIG. 6 is a cross-sectional view taken along line 6-6 in FIG. 3.
Figure 7:
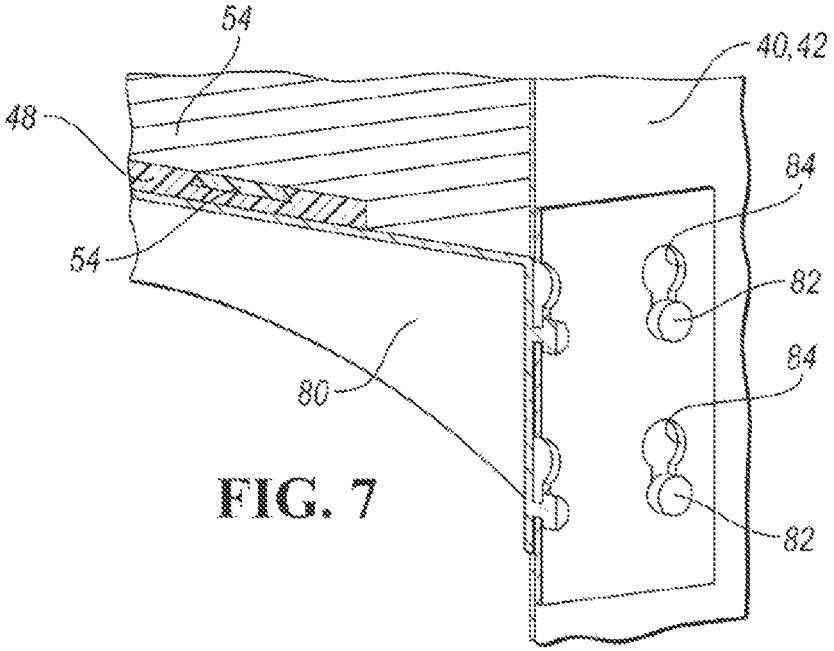
FIG. 7 is a cross-sectional view taken along line 7-7 in FIG. 3.

Referring to FIG. 1, generally a refrigerator 10 of the two-door bottom mount type is illustrated. However, it should be understood that this disclosure could apply to any type of refrigerator, such as a side-by-side, French-Door Bottom Mount, or a top-mount type. As shown in FIG. 1, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The fresh food compartment 12 and freezer compartment 14 may be referred to as internal cavities that are defined by the walls of the refrigerator 10. It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The refrigerator 10 includes one or more refrigeration loops (not shown) that are configured to cool the air the within the fresh food compartment 12 and the freezer compartment 14. The refrigeration loop includes at least a compressor, an evaporator that cools air being delivered to the fresh food compartment 12 and/or the freezer compartment 14, a condenser that rejects heat to ambient surroundings, and a thermal expansion valve. Fans may be utilized to direct air across the evaporator and the condenser to facilitate exchanging heat. The compressor and the fans may be connected to a controller. Sensors that measure the air temperature within the fresh food compartment 12 and the freezer compartment 14 may be in communication with the controller. The controller may be configured to operate the compressor, fans, etc. in response to the air temperature within the within the fresh food compartment 12 and the freezer compartment 14 being less than a threshold.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The refrigerator 10 includes panels or internal walls 16 that define the fresh food compartment 12 and the freezer compartment 14. The walls 16 may more specifically form an internal liner of the refrigerator 10. The walls 16 may include a rear or back wall, a top wall, a bottom wall, and two opposing side walls. One or more shelves 18 may be secured to the walls 16 within the fresh food compartment 12. One of more drawers 20 may be slidably secured to the shelves 18 or the walls 16 within the fresh food compartment 12. One or more crisper drawers 22 may be slidably secured to the shelves 18 or the walls 16 within the fresh food compartment 12. The crisper drawer 22 may more specifically be a drawer defining a storage space that is kept at a desired humidity that may be different from the remainder of the fresh food compartment 12, but that is optimal for maintaining freshness of fruits and vegetables.

The refrigerator 10 includes an outer shell, frame, or housing that comprises several exterior panels or walls 24. The outer shell, frame, or housing that comprises several exterior panels or walls 24 may also be referred to as the refrigerator cabinet wrapper. The exterior walls 24 may include a rear or back wall, a top wall, a bottom wall, and two side walls. The two side walls may be referred to as first and second side walls. An insulating material, such as an insulating foam, may be disposed between each exterior wall 24 and an adjacent corresponding interior wall 16 in order reduce the heat transfer from the ambient surroundings to the fresh food compartment 12 and the freezer compartment 14, which increases the efficiency of the refrigerator 10. Each exterior wall 24, adjacent corresponding interior wall 16, and the insulating material disposed between each exterior wall 24 and adjacent corresponding interior wall 16 may collectively be referred to as a single wall of the cabinet of the refrigerator.

The refrigerator 10 may have one or more doors 26, 28 that provide selective access to the interior volume of the refrigerator 10 where consumables may be stored. As shown, the fresh food compartment door is designated 26, and the freezer door is designated 28. The doors 26, 28 may be rotatably secured to the frame or housing of the refrigerator 10 by one or more hinges.

The doors 26, 28 may each include an exterior panel 30 and an interior panel 32 that is disposed on an internal side of the respective exterior panel 30 of each door 26, 28. The interior panels 32 may be configured to face the fresh food compartment 12 and freezer compartment 14 when the doors 26, 28 are in closed positions. The interior panels 32 may more specifically be door liners. An insulating material, such as an insulating foam, may be disposed between the exterior panels 30 and an adjacent corresponding interior panel 32 of each door 26, 28 in order reduce the heat transfer from the ambient surroundings and increase the efficiency of the refrigerator 10.

The doors 26, 28 may also include storage bins 34 that are able to hold food items or containers. The storage bins 34 may be secured to the interior panels 32 of each door 26, 28. Alternatively, the storage bins 34 may be integrally formed within or defined by the interior panels 32 of each door 26. 28. In yet another alternative, a portion of the storage bins 34 may be secured to the interior panels 32 the doors 26, 28, while another portion of the storage bins 34 may be integrally formed within or defined by the interior panels 32 the doors 26, 28. The storage bins 34 may include shelves (e.g., a lower surface upon, which a food item or container may rest upon) that extend from back and/or side surfaces of the interior panels 32 of the doors 26, 28.

Please note that the configuration of shelves and drawers in FIG. 1 is for illustrative purposes only and that the shelves and drawers in FIG. 1 may be rearranged to any desirable configuration.

Referring to FIGS. 2-7 an adjustable shelf 36 for the refrigerator 10 is illustrated. As previously stated, (i) the refrigerator 10 has a cabinet 38 that is formed by the walls 40 of the refrigerator 10 and (ii) the walls 40 may be collectively formed from an exterior wall 24, an adjacent corresponding interior wall 16, and the insulating material disposed between the exterior wall 24 and the adjacent corresponding interior wall 16. The walls 40 may include a rear wall 42, two opposing side walls 44 extending forward from the rear wall 42, a top wall 46, a bottom wall (not shown in FIG. 2 or 3), and a partition wall (not shown FIG. 2 or 3) that separates the fresh food compartment 12 and the freezer compartment 14. The cabinet 38, or more specifically the walls 40, define the internal cavities (e.g., the fresh food compartment 12 and the freezer compartment 14).

The adjustable shelf 36 is disposed within one of the internal cavities (e.g., the fresh food compartment 12 or the freezer compartment 14). The adjustable shelf 36 has a base portion 48 that defines a plurality of slots or grooves 50. The base portion 48 may also be referred to as the base or the primary portion of the adjustable shelf 36. The grooves 50 may be aligned with each other and may form an array of grooves 50 that extend between the opposing side walls 44. The grooves 50 may be substantially parallel to each other, the top wall 46, and/or the bottom wall. Substantially parallel may refer to any incremental value that is between exactly parallel and 15° from exactly parallel. The grooves 50 may be substantially perpendicular to the rear wall 42 and/or the two opposing side walls 44. Substantially perpendicular may refer to any incremental value that is between exactly perpendicular and 15° from exactly perpendicular.

The adjustable shelf 36 has an extendable portion 52. The extendable portion 52 may also be referred to as the expansion member or secondary portion of the adjustable shelf 36. The extendable portion 52 has a plurality of protrusions 54 extending therefrom. The protrusions 54 may be aligned with each other and may form an array of elongated protrusions 54 that extend between the opposing side walls 44. The protrusions 54 may be substantially parallel to each other, the top wall 46, and/or the bottom wall. Substantially parallel may refer to any incremental value that is between exactly parallel and 15° from exactly parallel. The protrusions 54 may be substantially perpendicular to the rear wall 42 and/or the two opposing side walls 44. Substantially perpendicular may refer to any incremental value that is between exactly perpendicular and 15° from exactly perpendicular.

Each protrusion 54 is disposed within and slidable within one of the grooves 50. The extendable portion 52 is configured to transition between a first position 56 and a second position 58 relative to the base portion 48 via sliding the protrusions 54 within the grooves 50 in a direction 60 that extends between the opposing side walls 44 and along a width of the cabinet 38 or a width of the refrigerator 10. More specifically, sliding the protrusions 54 within the grooves 50 in direction 60 results in an adjustment to a dimension (e.g., a width, W) of the adjustable shelf 36. Stated in other terms, the protrusions 54 are extendable from and retractable within the grooves 50 in order to adjust the dimension (e.g., the width, W) of the adjustable shelf 36.

The adjustable shelf 36 is adjustable between a first dimension (e.g., a first width, $W_1$) that corresponds to the extendable portion 52 being in the first position 56 and a second dimension (e.g., a second width, $W_2$) that corresponds to the extendable portion 52 being in the second position 58. The adjustable shelf 36 spans a width of the internal cavity (e.g., the distance between the internal surfaces of the opposing side walls 44 within fresh food compartment 12 or the freezer compartment 14) when adjusted to the first dimension (e.g., the first width, $W_1$). The adjustable shelf 36 does not span the width of the internal cavity when adjusted to the second dimension (e.g., the second width, $W_2$).

The plurality of grooves 50 each have a keyed cross-sectional area 61. The plurality of protrusions 54 each have a mating cross-sectional area 62 that is the same in shape as the keyed cross-sectional areas 61 but slightly smaller than the keyed cross-sectional areas 61 to provide clearance so that the protrusions 54 may slide into and out of the grooves 50 in direction 60. The engagement between the protrusions 54 and the grooves 60 restricts movement of the extendable portion 52 to a single direction (i.e., direction 60) relative to the base portion 48. More specifically, the shapes of the keyed cross-sectional areas 61 and the mating cross-sectional areas 62 result in the protrusions 54 being trapped within a respective groove 50 such that (i) up and down movement of the protrusions 54 within the grooves 50 between the top wall 46 and the bottom wall is restricted, (ii) movement of the protrusions 54 between the rear wall 42 and the door (e.g., door 26 or door 28) within the grooves 50 is restricted, and (iii) rotation in any direction of the protrusions 54 within the grooves 50 is restricted. The keyed cross-sectional areas 61 and the mating cross-sectional areas 62 may more specifically be trapezoid-shaped. The tops of the grooves 50 may be open.

The base portion 48 has a proximal end 64 and a distal end 66. The proximal end 64 is secured to one of the opposing side walls 44. More specifically, the proximal end 64 may be secured to one of the opposing side walls 44 via blocks 68 that extend inward into the internal cavity (e.g., the fresh food compartment 12 or the freezer compartment 14) from the opposing side walls 44. The extendable portion 52 is secured to the distal end 66. When the extendable portion 52 is in the first position 56, the extendable portion is also secured to other of the opposing side walls 44 via additional blocks 68 that extend inward into the internal cavity.

When the extendable portion 52 is in the first position 56 additional clearance for items 70 that may be disposed along a shelf 72 just below the adjustable shelf 36 is not provided. However, when the extendable portion 52 is in the second position 58 additional clearance for the items 70 that may be disposed along the shelf 72 just below the adjustable shelf 36 is provided. This adjustment provides for flexibility depending on what items are being stored in the refrigerator. When a large or tall item is being stored, the extendable portion 52 may be placed in the second position 58 providing additional clearance for the large items on shelf 72. When a large or tall item is not be stored, the extendable portion 52 may be placed in the first position 56 providing additional storage for multiple smaller items.

The base portion 48 may define indentations or dimples 74 toward inward ends of the grooves 50. More specifically, the indentations or dimples 74 may be defined along the bottom of the grooves 50. The protrusions 54 may include mating projections 76 that are configured to engage the grooves 50 to maintain the extendable portion 52 in the second position 58. The outer edges of the dimples 74 and projections 76 may be ramped along an angle so that the engagement between the dimples 74 and projections is maintained when a force is applied to the extendable portion 52 in direction 60 that is less than a threshold but is not maintained when the force is greater than the threshold so that the extendable portion may be transitioned out of the second position 58.

The extendable portion 52 may further include a handle 78 extending upward from an end of the extendable portion 52. More specifically, the handle 78 may extend upward from the end of the extendable portion 52 that is opposite of protrusions 54 and that is configured to engage the blocks 68 when the extendable portion 52 is in the first position 56. A support bracket 80 extends from and is secured to the rear wall 42. The support bracket 80 is configured to support a bottom of the base portion 48 along the distal end 66, which is desirable to provide stability to the adjustable shelf 36 for when the extendable portion 52 is transitioned out of the first position 56 and disengages the blocks 68 supporting the extendable portion 52 along the other of the opposing side walls 44. The support bracket 80 may include pins 82 that are configured to engage slots 84 defined along the rear wall 42 in order to secure the support bracket 80 to the rear wall 42.

Figure 8:
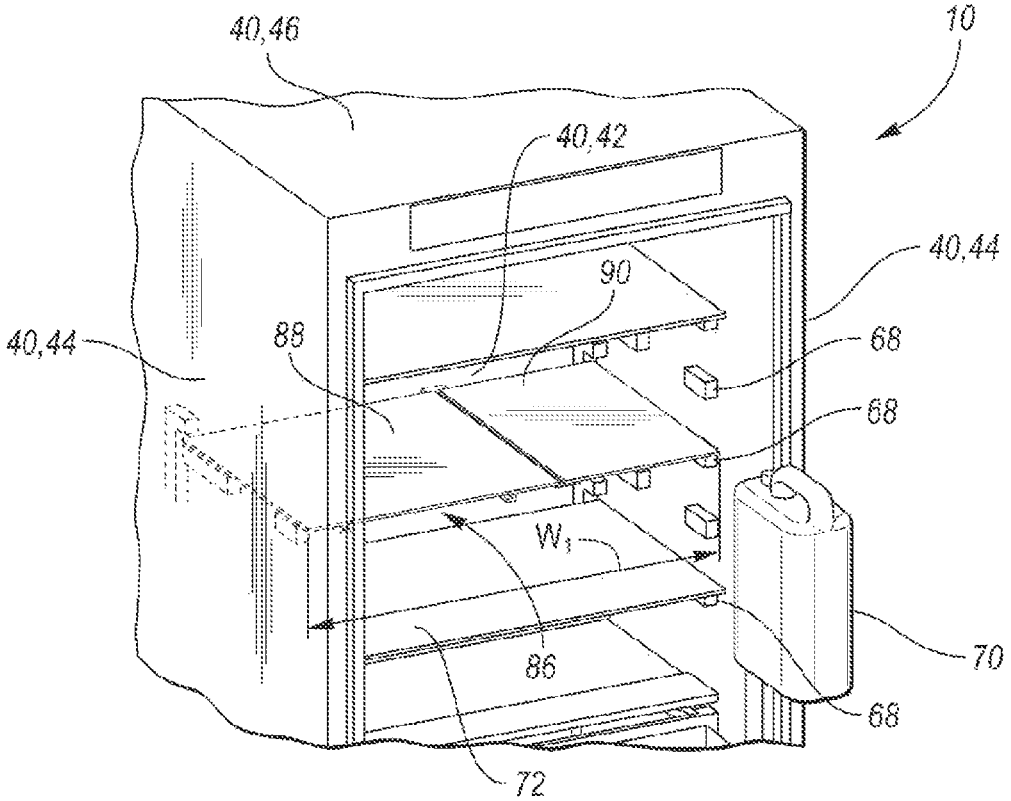
FIG. 8 is a partial isometric front view of the refrigerator with the door removed illustrating an alternative embodiment of the adjustable shelf in a first position.
Figure 9:
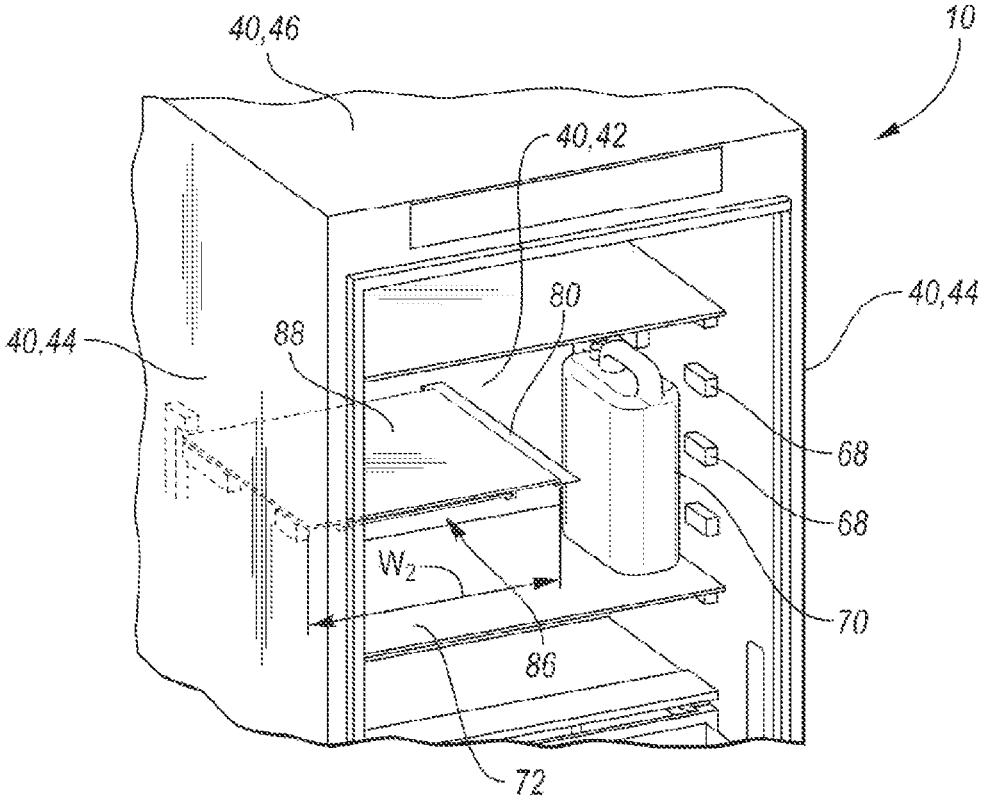
FIG. 9 is a partial isometric front view of the refrigerator with the door removed illustrating the alternative embodiment of the adjustable shelf in a second position.
Figure 10:
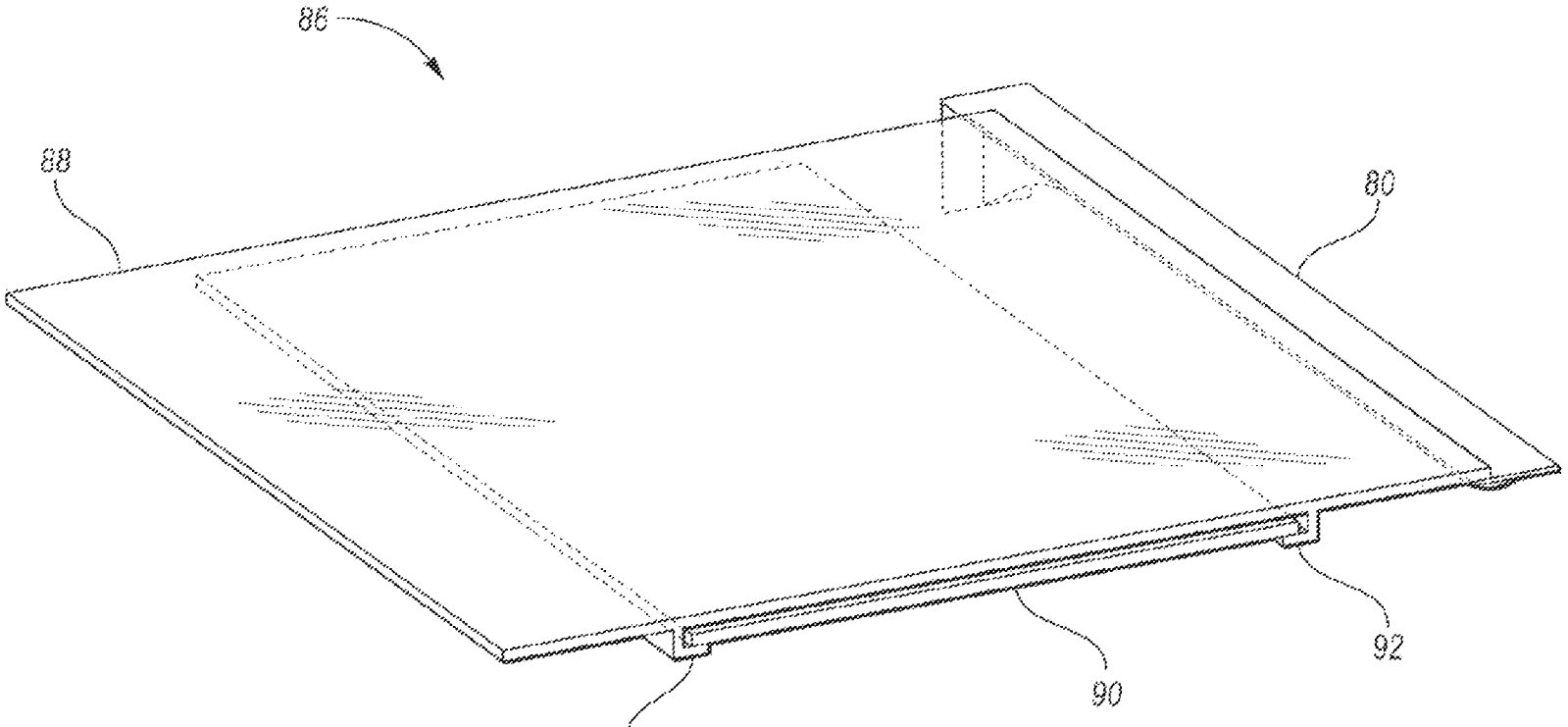
FIG. 10 is an isometric front view of the alternative embodiment of the adjustable shelf.

Referring to FIGS. 8-10, an alternative embodiment of an adjustable shelf 86 for the refrigerator 10 is illustrated. Unless otherwise stated herein, the adjustable shelf 86 should be construed to have the same characteristics as adjustable shelf 36. The adjustable shelf 86 is also adjustable between a first dimension (e.g., a first width, $W_1$) and a second dimension (e.g., a second width, $W_2$). The adjustable shelf 86 spans a width of the internal cavity (e.g., the distance between the internal surfaces of the opposing side walls 44 within fresh food compartment 12 or the freezer compartment 14) when adjusted to the first dimension (e.g., the first width, $W_1$). The adjustable shelf 86 does not span the width of the internal cavity when adjusted to the second dimension (e.g., the second width, $W_2$).

The main difference between adjustable shelf 86 and adjustable shelf 36 is that adjustable shelf 86 does not include the projection groove engagement of adjustable shelf 36, but instead includes a primary plate 88 and a secondary plate 90. The secondary plate 90 is simply removed when a large or tall (e.g., item 70) needs to be stored on the shelf 72 that is below the adjustable shelf 86. The base plate 88 includes a pair of opposing projections 92 extending downward therefrom that collectively define a T-slot. The T-slot is sized to receive the secondary plate 90 when the secondary plate 90 is not being utilized.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a cabinet having a rear wall and opposing side walls extending forward from the rear wall, wherein the rear wall and opposing side walls define an internal cavity; and a shelf (i) disposed within the internal cavity, (ii) having a base portion defining a plurality of aligned grooves, and (iii) having an extendable portion having a plurality of aligned protrusions, wherein (a) the grooves extend downward from a top surface of the base portion to recessed surfaces of the base portion, (b) the extendable portion defines slots between the protrusions that extend through the extendable portion from a top to a bottom of the extendable portion, (c) each protrusion is disposed and slidable within one of the aligned grooves, and (d) the extendable portion is configured to transition between first and second positions relative to the base portion via sliding the plurality of aligned protrusions within the plurality of aligned grooves, and wherein (a) the base portion defines at least one indentation extending downward from at least one of the recessed surfaces, (b) the protrusions include at least one projection extending downward therefrom, and (c) the at least one projection is configured to engage the at least one indentation to maintain the extendable portion in the second position where the shelf does not span a distance between the opposing side walls.

2. The refrigerator of claim 1, wherein the plurality of aligned grooves each have a keyed cross-sectional area, and wherein the plurality of aligned protrusions each have a mating cross-sectional area such that engagement between the protrusions and the aligned grooves restricts movement of the extendable portion to a single direction relative to the base portion.

3. The refrigerator of claim 2, wherein each keyed cross-sectional area and each mating cross-sectional area are trapezoid-shaped.

4. The refrigerator of claim 1, wherein (i) the base portion has a proximal end and a distal end, (ii) the proximal end is secured to one of the opposing side walls, and (iii) the extendable portion is secured to the distal end.

5. A refrigerator comprising:

a cabinet defining an internal cavity; and a shelf (i) disposed within the internal cavity, (ii) having a base defining grooves, and (iii) having an expansion member having protrusions extending therefrom, wherein (a) each protrusion is disposed and slidable within one of the grooves, (b) the grooves extend downward from a top surface of the base to recessed surfaces of the base, (c) the expansion member defines slots between the protrusions that extend through the expansion member from a top to a bottom of the expansion member, and (d) a width of the shelf is adjustable via sliding the protrusions within the grooves, and wherein (a) the base defines at least one indentation extending downward from at least one of the recessed surfaces, (b) the protrusions include at least one projection extending downward therefrom, and (c) the at least one projection is configured to engage the at least one indentation to maintain the expansion member in a retracted position.

6. The refrigerator of claim 5, wherein each groove has a keyed cross-sectional area, and wherein each protrusion has a mating cross-sectional area such that engagement between the protrusions and the grooves restricts movement of the expansion member to a single direction relative to the base.

7. The refrigerator of claim 6, wherein each keyed cross-sectional area and each mating cross-sectional area are trapezoid-shaped.

8. The refrigerator of claim 5, wherein (i) the base has a proximal end and a distal end, (ii) the proximal end is secured to a first side wall of a pair of opposing side walls within the internal cavity, and (iii) the expansion member is secured to the distal end.

9. The refrigerator of claim 8 further comprising a support bracket (i) extending from and secured to a rear wall of the cabinet within the internal cavity and (ii) configured to support a bottom of the base along the distal end.

10. A refrigerator shelf comprising:

a primary portion defining keyed grooves, wherein the grooves extend downward from a top surface of the primary portion to recessed surfaces of the primary portion; and a secondary portion including elongated protrusions that are extendable from and retractable within the grooves in order to adjust a width of the shelf, wherein the secondary portion defines slots between the protrusions that extend through the extendable portion from a top to a bottom of the extendable portion, and wherein (i) the primary portion defines at least one indentation extending downward from at least one of the recessed surfaces, (ii) the elongated protrusions include at least one projection extending downward therefrom, and (iii) the at least one projection is configured to engage the at least one indentation to maintain the secondary portion in a retracted position.

11. The refrigerator shelf of claim 10, wherein the elongated protrusions each have a cross-sectional area that engages one of the keyed grooves such that engagement between the protrusions and the keyed grooves restricts movement of the secondary portion to a single direction relative to the primary portion.

12. The refrigerator of claim 1, wherein outer edges of the at least one indentation and outer edges of the at least one projection are ramped such that the engagement between the at least one indentation and the at least one projection is maintained when a force is applied to the extendable portion that is less than a threshold but is not maintained when the force is greater than the threshold.

13. The refrigerator of claim 1, wherein the top surface of the base portion and top surfaces of the protrusions are coplanar.

14. The refrigerator of claim 5, wherein outer edges of the at least one indentation and outer edges of the at least one projection are ramped such that the engagement between the at least one indentation and the at least one projection is maintained when a force is applied to the extendable portion that is less than a threshold but is not maintained when the force is greater than the threshold.

15. The refrigerator of claim 5, wherein the top surface of the base and top surfaces of the protrusions are coplanar.

16. The refrigerator shelf of claim 10, wherein outer edges of the at least one indentation and outer edges of the at least one projection are ramped such that the engagement between the at least one indentation and the at least one projection is maintained when a force is applied to the secondary portion that is less than a threshold but is not maintained when the force is greater than the threshold.

17. The refrigerator shelf of claim 10, wherein the top surface of the primary portion and top surfaces of the elongated protrusions are coplanar.

* * * * *